US006813837B1

(12) United States Patent
Chen

(10) Patent No.: US 6,813,837 B1
(45) Date of Patent: Nov. 9, 2004

(54) BI-DIRECTIONAL ROTATION PNEUMATIC CUTTING MACHINE

(76) Inventor: Lung-Hui Chen, No. 296-1, Jungshan Rd., Jubei City, Hsinchu (TW)

( * ) Notice: Subject to any disclaimer, the term of this patent is extended or adjusted under 35 U.S.C. 154(b) by 10 days.

(21) Appl. No.: 10/449,475

(22) Filed: Jun. 2, 2003

(51) Int. Cl.[7] ..... B26B 7/00

(52) U.S. Cl. ..... 30/272.1; 30/388; 30/342; 83/666; 83/698.41; 83/698.51

(58) Field of Search ..... 30/277.4, 272.1, 30/388, 337, 342; 83/666, 676, 698.41, 698.51; 279/99, 100, 101; 451/342, 359

(56) References Cited

U.S. PATENT DOCUMENTS

| | | | | | |
|---|---|---|---|---|---|
| 805,402 | A | * | 11/1905 | Akins | 279/101 |
| 4,730,952 | A | * | 3/1988 | Wiley | 403/316 |
| 4,810,139 | A | * | 3/1989 | Regan | 408/239 A |
| 4,850,109 | A | * | 7/1989 | Kerwin | 30/122 |
| 5,406,752 | A | * | 4/1995 | Neff | 451/344 |
| 6,093,090 | A | * | 7/2000 | Tosto et al. | 451/342 |

* cited by examiner

*Primary Examiner*—Kenneth E. Peterson
*Assistant Examiner*—Omar Flores Sánchez
(74) *Attorney, Agent, or Firm*—Birch, Stewart, Kolasch & Birch, LLP

(57) ABSTRACT

A bi-directional rotation pneumatic cutting machine includes an operation section which has an actuator to drive an output shaft to rotate in two directions and a fastening mechanism coupled on the output shaft. The fastening mechanism includes a coupling head which has first reverse threads formed in the interior for fastening to the output shaft, an anchor member engaged with the coupling head with second reverse threads formed thereon, and a fastener which has first positive threads formed thereon to run through the anchor member and engage with second positive threads formed on the output shaft. The positive threads and the reverse threads are engageable with each other to allow the pneumatic cutting machine to rotate in a positive direction or a reverse direction according to different requirements without loosening and direct sparks, cutting debris or dusts generated in cutting processes in a desired direction without polluting environment or hurting people and working pieces.

5 Claims, 3 Drawing Sheets

BI-DIRECTIONAL ROTATION PNEUMATIC CUTTING MACHINE

FIELD OF THE INVENTION

The present invention relates to a bi-directional rotation pneumatic cutting machine and particularly to a pneumatic cutting machine capable of rotating in the positive direction or the reverse direction depending on different requirements to direct sparks, cutting debris or dusts generated in the cutting process in a desired direction.

BACKGROUND OF THE INVENTION

Conventional cutting machines generally rotate in an unidirectional manner. As cutting machines are designed in many different types, they are widely used in many industries such as iron work, machinery, wood working, molding, automobiles and motorcycles, repairs and maintenance, glass fibers, electronics, and the like.

The unidirectional rotation cutting machine mainly includes an operation section and a grasp section. The operation section has a fastening mechanism. FIG. 1 illustrates a typical fastening mechanism for pneumatic cutting machines. As shown in the drawing, its operation section has an output shaft 6 extending outwards. The output shaft 6 has a rear section to couple with a bearing 7 and a front section to screw a coupling head 1. The coupling head 1 is fastened by a fastener 2. When in use, a cutting tool 4 is sandwiched and anchored between the coupling head 1 and the fastener 2. The output shaft 6 is driven by a driving mechanism to rotate at high speed to drive the cutting tool 4 to rotate in one direction. When the unidirectional cutting machine performs cutting operation, sparks, debris, powders or dusts are inevitably generated. The sparks may spew to the surrounding and cause fire when inflammable goods are around. Dusts produce environmental pollution. The debris of the cutting material scatter around and may cause severe hazards to the health and safety of operators. To remedy these concerns, a mask 9 is usually installed above the coupling head 1 that has an interference-avoiding section 191 to enable users to drive or couple the fastener 2.

Moreover, due to conventional cutting machines rotate in one direction, when cutting a narrower working piece or corners, the grasp section is constrained due to design limitation and allows only surface machining to be performed on the working piece. Some corners cannot be machined smoothly by the conventional cutting machines, and operators have to adopt other operating gestures or approaches to do machining operation. Those abnormal operation methods often affect cutting quality and produce defects on the machining surface.

SUMMARY OF THE INVENTION

The primary object of the invention is to resolve the aforesaid disadvantages and overcome the drawbacks of the prior art. The invention has reverse threads on an outer wall of one end of an anchor member and positive threads on its interior to enable the invention to rotate positively or reversely according to different requirements. Thus sparks, grinding debris or dusts generated in the cutting process may be directed in a desired direction to avoid polluting operation environment or hurting people and working pieces.

In order to achieve the foregoing object, the bi-directional rotation pneumatic cutting machine of the invention includes an actuator in an operation section to drive an output shaft to rotate in both directions, and a fastening mechanism fastening to the output shaft. The fastening mechanism includes a coupling head which has reverse threads formed in the interior to couple with the output shaft. The coupling head further is coupled with an anchor member which has another reverse threads. The anchor member is run through by a fastener which has positive threads to fasten to another positive threads formed on the output shaft. By means of the fastening mechanism that has elements of positive and negative threads and may be fastened tightly with one another, the invention may rotate positively or reversely according to different requirements without loosening. And sparks, cutting debris or dusts generated in the cutting process may be directed in a desired direction without polluting the operation environment or hurting people and the working pieces.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
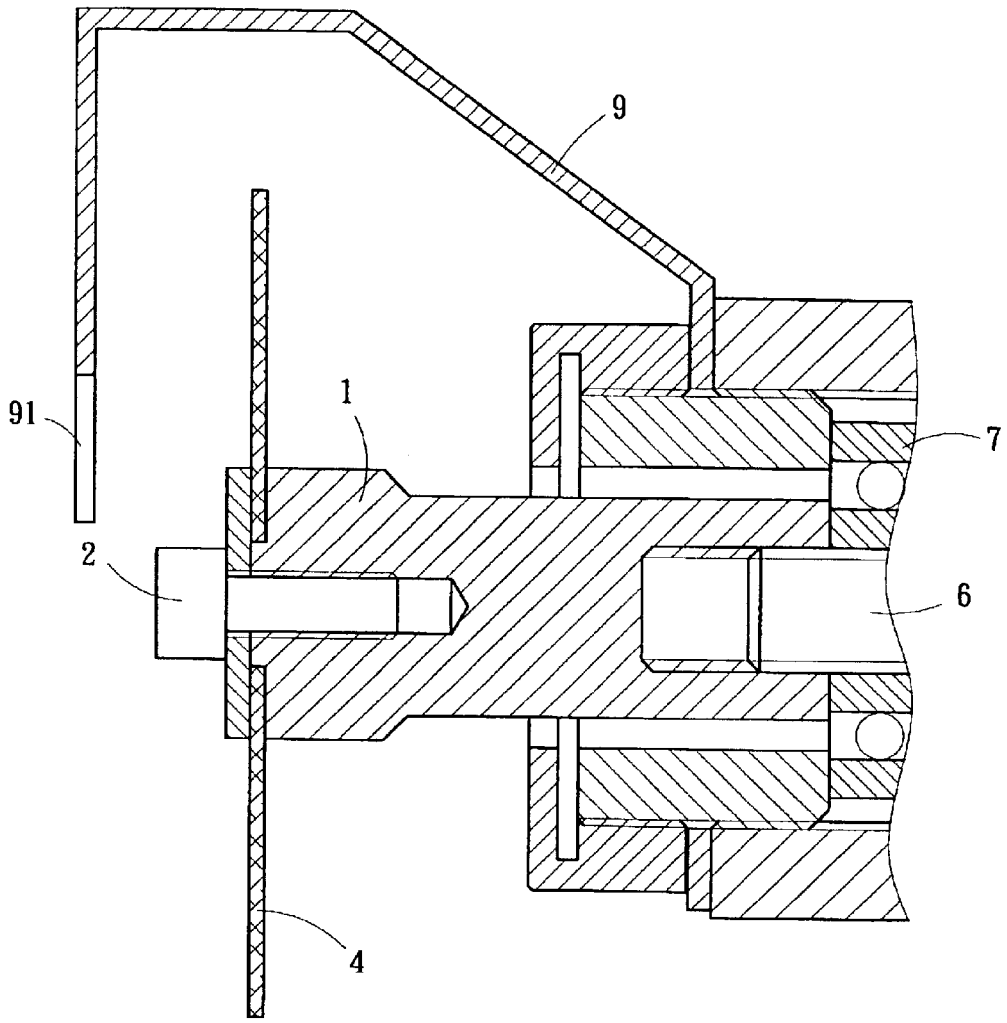
Fig.1 PRIOR ART
FIG. 1 is a sectional view of the fastening mechanism of a conventional pneumatic cutting machine.
Figure 2:
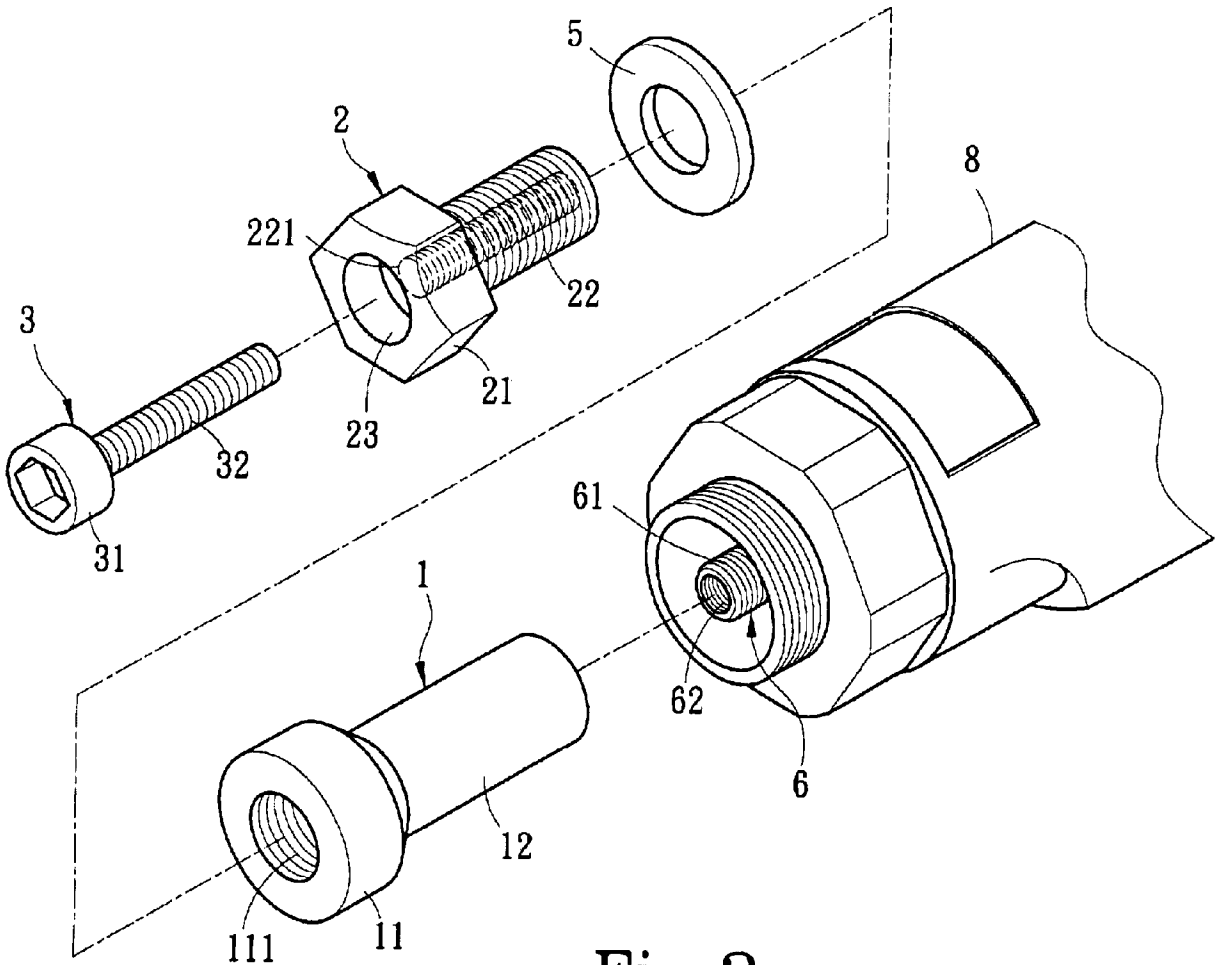
FIG. 2 is a fragmentary exploded view of the present invention.
Figure 3:
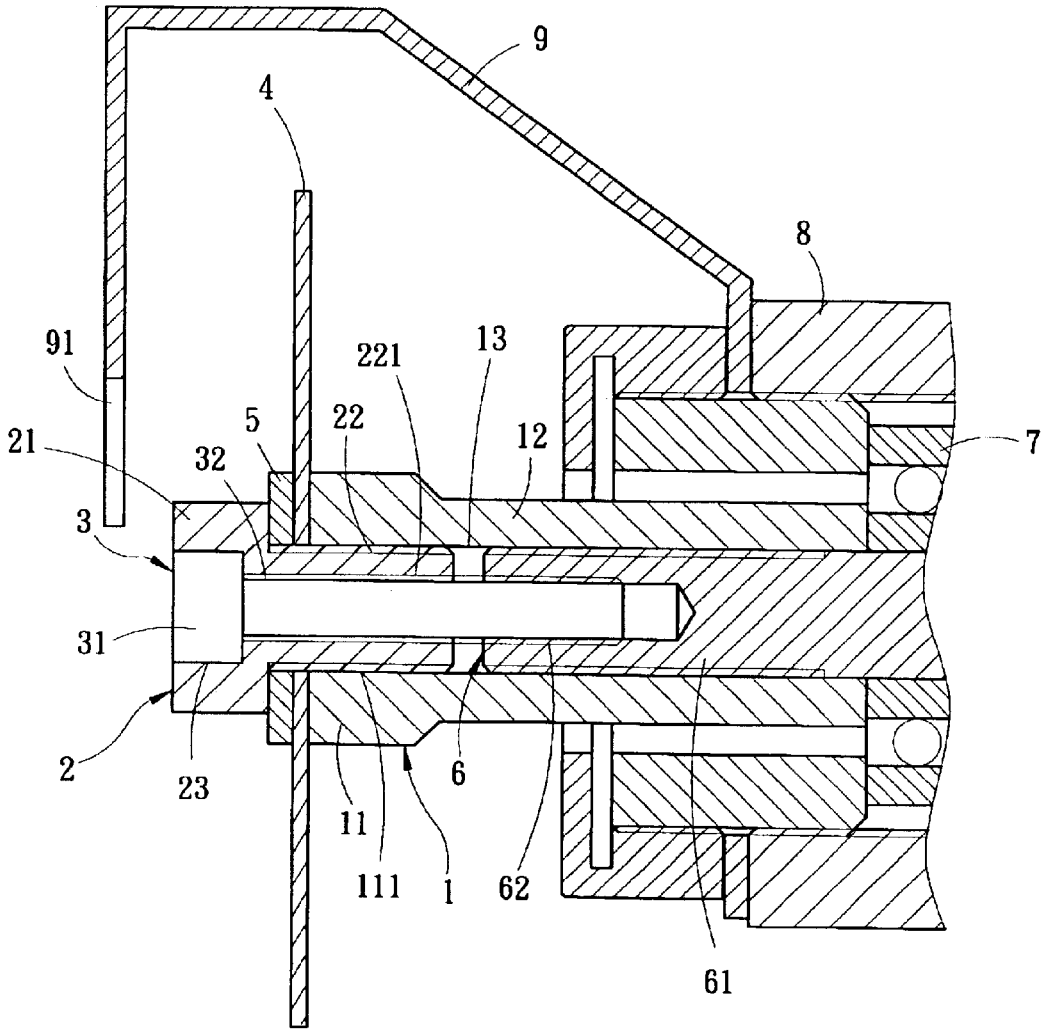
FIG. 3 is a fragmentary sectional view of the present invention.

Please refer to FIGS. 2 and 3 for an exploded and a fragmentary sectional view of the present invention. As shown in the figures, the bi-directional rotation pneumatic cutting machine of the invention includes an operation section 8 which has an actuator (not shown in the drawings) to drive an output shaft 6 to rotate in both directions. The output shaft 6 further is coupled with a fastening mechanism. The fastening mechanism consists of a coupling head 1, an anchor member 2 and a fastener 3.

The output shaft 6 has an inner wall which has positive threads 62 and an outer wall which has reverse threads 61. The output shaft 6 also is coupled with a bearing 7 to reduce friction between the output shaft 6 and the fastening mechanism.

The coupling head 1 has two ends communicating with each other. One end has a fastening section 12 to engage with the reverse threads 61 of the output shaft 6 and the other end forms a bucking section 11. The interior of the coupling head 1 has reverse threads 111.

The anchor member 2 has two ends communicating with each other. One end has reverse threads 22 formed on the outer wall and the other end forms a polygonal stop section 21 which has a housing trough 23. The interior of the anchor member 2 has positive threads 221.

The fastener 3 has one end forming positive threads 32 to engage with the positive threads 221 of the anchor member 2 and the positive threads 62 of the output shaft 6, and other end forming a fastening head 31.

Referring to FIG. 3, when in use, a cutting tool 4 is sandwiched between the coupling head 1 and the anchor member 2. The cutting tool 4 and the anchor member 2 are further interposed by an anchor washer 5 to reinforce anchoring of the two. The fastener 3 that has the positive threads 32 may be screwed in the anchor member 2 and directly engage with the positive threads 61 on the inner wall of the output shaft 6 for anchoring. The output shaft 6 is driven by the actuator (not shown in the drawings) in the operation section 8 to rotate at high speed to drive the cutting tool 4 to rotate.

When the invention rotates clockwise (positive direction), the reverse threads 111 and 22 of the coupling head 1 and the anchor member 2 are engaged with each other, hence in the positive rotation condition both elements are easy to loosen. When the loose condition occurs, the fastener 3 and the interior of the anchor member 2 and the inner wall of the output shaft 6 are engaged with one another through reverse threads 32, 221 and 62, thus the loose condition occurred to the coupling head 1 and the anchor member 2 may be stopped by the positive rotation relationship among the fastener 3 and the anchor member 2 and the output shaft 6 to remain a tightly coupling condition. By the same token, when the invention rotates counterclockwise (reverse direction), the fastener 3 and the anchor member 2 and the output shaft 6 rotate in the reverse direction and tend to become loose. However, the coupling head 1 and the anchor member 2 are rotated in the positive direction to become tighter. Therefore, by means of the mutual coupling relationship between the positive threads and the reverse threads on various elements of the fastening mechanism, the fastening mechanism may rotate clockwise or counterclockwise smoothly without loosening or slipping. The positive threads 221, 32, and 62, and reverse threads 111, 22 and 61 may be interchanged according to different user requirements. Namely, the positive threads may be changed to reverse threads while the reverse threads may be changed to positive threads. Thus sparks, cutting debris and dusts generated in the cutting process may be directed to a desired direction to avoid polluting the environment or hurting people and working pieces.

Moreover, after the elements of the fastening mechanism have been assembled, a mask 9 may be installed on the operation section 8 to prevent dust or debris generated during cutting operations from scattering around. The mask 9 may has an interference-avoiding section 91 to enable users to fine tune the fastener 3.

What is claimed is:

1. A bi-directional rotation pneumatic cutting machine comprising an operation section which has an actuator to drive an output shaft to rotate in two directions and a fastening mechanism coupled on the output shaft, wherein the fastening mechanism includes:

a coupling head which has two ends communicating with each other and first reverse threads formed in the interior for fastening to the output shaft;

an anchor member which has two ends communicating with each other and second reverse threads formed on an outer wall of one end thereof to engage with the coupling head; and a fastener which has one end with first positive threads formed thereon to run through the anchor member and engage with second positive threads formed on the output shaft;

wherein the positive threads and the reverse threads are engageable with each other to allow the pneumatic cutting machine to rotate in a positive direction or a reverse direction according to different requirements without loosening and direct sparks, cutting debris or dusts generated in cutting processes in a desired direction without polluting environment or hurting people and working pieces.

2. The bi-directional rotation pneumatic cutting machine of claim 1, wherein one end of the coupling head forms a fastening section and other end of the coupling head forms a bucking section.

3. The bi-directional rotation pneumatic cutting machine of claim 1, wherein the coupling head and the anchor member are interposed by an anchor washer.

4. The bi-directional rotation pneumatic cutting machine of claim 1, wherein one end of the.anchor member forms a stop section which has a housing trough formed therein.

5. The bi-directional rotation pneumatic cutting machine of claim 1, wherein the anchor member has other end forming a fastening head.

* * * * *